US010739121B2

(12) United States Patent
Fitzgerald et al.

(10) Patent No.: US 10,739,121 B2
(45) Date of Patent: Aug. 11, 2020

(54) BLASTING MAT AND METHOD OF MANUFACTURING SAME

(71) Applicant: B2B Industrial Inc., Copper Cliff (CA)

(72) Inventors: Kevin James Fitzgerald, Copper Cliff (CA); Denis Blais, Sudbury (CA)

(73) Assignee: B2B Industrial Inc., Cooper Cliff, Ontario (CA)

( * ) Notice: Subject to any disclaimer, the term of this patent is extended or adjusted under 35 U.S.C. 154(b) by 0 days.

(21) Appl. No.: 16/393,013

(22) Filed: Apr. 24, 2019

(65) Prior Publication Data

US 2019/0323812 A1 Oct. 24, 2019

Related U.S. Application Data

(60) Provisional application No. 62/661,851, filed on Apr. 24, 2018.

(51) Int. Cl.
*F42D 5/05* (2006.01)

(52) U.S. Cl.
CPC ..... *F42D 5/05* (2013.01)

(58) Field of Classification Search
CPC ..... F42D 5/05; F41H 5/00; F41H 5/02; F41H 5/04; F41H 5/0478; F41H 5/06; E01C 9/08; E01C 9/086
See application file for complete search history.

(56) References Cited

U.S. PATENT DOCUMENTS 2,474,904 A 7/1949 Mazzella
2,806,426 A * 9/1957 Klokseth ..... F42D 5/05 102/303
2,926,605 A * 3/1960 Hammel, Jr. ..... F42D 5/05 102/303
3,331,322 A * 7/1967 Belanger ..... F42D 5/05 102/303
3,371,604 A * 3/1968 Lundgren ..... F42D 5/05 102/303
3,567,568 A * 3/1971 Windecker ..... F41H 5/0478 442/224
3,793,953 A * 2/1974 Lewis ..... F42D 5/05 102/303

(Continued)

FOREIGN PATENT DOCUMENTS

CN 208134169 U 3/2018
FR 1482307 A * 5/1967 ..... F42D 5/05

(Continued)

OTHER PUBLICATIONS

Blasting mats—BERGMA AS; information downloaded on Feb. 28, 2019 from http://www.bergma.no/english/english/blasting-mats.

(Continued)

*Primary Examiner* — Benjamin P Lee

(57) ABSTRACT

A blasting mat including a number of resilient elements arranged in a number of parallel rows that are located in a number of predetermined regions of the blasting mat. The resilient elements in each region are respectively subjected to a preselected compression pressure, to cause each region to have a respective preselected density within a range of preselected densities. The preselected density of at least a second selected one of the regions is greater than the preselected density of at least a first selected one of the regions.

12 Claims, 12 Drawing Sheets

(56) References Cited

U.S. PATENT DOCUMENTS 3,943,853 A 3/1976 Robertson et al.
3,945,319 A * 3/1976 Meagher ..... F42D 5/05 102/303
4,315,463 A 2/1982 Arcand
4,678,702 A * 7/1987 Lancaster ..... B32B 27/12 428/193
4,801,217 A 1/1989 Goldberg
4,829,900 A * 5/1989 Van der Westhuizen ..... E21C 37/12 102/303
5,044,057 A 9/1991 Meagher
5,076,168 A * 12/1991 Yoshida ..... F42D 5/05 102/303
5,482,754 A 1/1996 Crook
6,080,460 A * 6/2000 Chapman ..... E01C 9/086 404/32
6,289,816 B1 * 9/2001 Keenan ..... F42B 39/16 102/303
6,622,631 B2 * 9/2003 Cho ..... E02F 3/04 102/302
D484,647 S * 12/2003 Casey ..... D29/100
6,655,290 B2 12/2003 Cho
2009/0280708 A1 * 11/2009 Marissen ..... F41H 5/0428 442/181
2012/0167754 A1 * 7/2012 Gillis ..... F41H 5/0428 89/36.02
2015/0040749 A1 * 2/2015 Bhatnagar ..... B29C 70/202 89/36.02

FOREIGN PATENT DOCUMENTS

GB 653556 A * 5/1951 ..... F42D 5/05
JP 02217797 A * 8/1990 ..... F42D 5/05
KR 101155240 11/2009
KR 20110057693 11/2009
RU 2265797 C1 12/2005
RU 2405125 C1 8/2009

OTHER PUBLICATIONS

Machine-generated English language translation of CN208134169U.
Machine-generated English language translation of KR101155240.
Machine-generated English language translation of KR101155240B1.
Machine-generated English language translation of KR20110057693.
Machine-generated English language translation of Abstract of RU2265797C1.
Machine-generated English language translation of RU2405125C1.

* cited by examiner

BLASTING MAT AND METHOD OF MANUFACTURING SAME

CROSS-REFERENCE TO RELATED APPLICATION

This application claims the benefit of U.S. Provisional Patent Application No. 62/661,851, filed on Apr. 24, 2018, the entirety of which is hereby incorporated by reference.

FIELD OF THE INVENTION

The present invention is a blasting mat with a body thereof having regions having different densities, and methods of manufacturing same.

BACKGROUND OF THE INVENTION

Blasting mats, typically made of portions of used vehicle tires held together by cables or other similar elements, are designed to limit the movement of ground (i.e., rock fragments, and soil) at a ground surface in response to detonation of an explosive below the ground surface. As is well known in the art, a blasting mat typically is positioned at a particular location for a blast, and then removed after the blast, and moved to another location, for use in connection with another detonation. The conventional blasting mat may be any suitable size, e.g., approximately 10 feet by 15 feet.

Accordingly, the weight of the blasting mat should be as low as possible, because of the need to move the blasting mat after each use. However, the typical blasting mat should also have sufficient weight to achieve an effective blanketing effect over the ground surface, to limit movement of portions of the ground surface in response to the detonation.

In general, substantially the same types of materials (e.g., portions of used vehicle tires) typically are used throughout the blasting mat. However, depending on the density of the material and the manner in which the blasting mat is used, this uniformity may result in unnecessary costs being incurred, e.g., in connection with the purchase of the materials, or in the costs incurred in handling the blasting mat.

For the purposes hereof, an "automobile tire" is understood to be a "PLT" (passenger and light truck tire), as the term was used under the Ontario Tire Stewardship Program (OTSP). It will therefore be understood that the "automobile" tire may be a tire for a passenger vehicle, or for a light truck (a pickup truck, or an SUV). In addition, for the purposes hereof, a "truck tire" is understood to be a "MTT" (medium truck tire), as the term was used in the OTSP. Accordingly, for the purposes hereof, the "truck" for which a "truck tire" is made is a transport truck.

The conventional method of forming a portion of a used automobile tire for use in a conventional blasting mat is as follows. As can be seen in FIG. 1A, a used automobile tire 10 typically is cut along a longitudinal center line 12 into two halves, identified in FIG. 1A by reference characters "$A_1$" and "$A_2$" for convenience. Conventionally, each of the two halves is then further divided into three substantially equal portions. For example, as illustrated in FIG. 1B, the used automobile tire half "$A_1$" is further divided into three substantially equal portions 14. Typically, in order to form a prior art blasting mat, the used automobile tire portions 14 are arranged in rows "R", each of the rows generally being parallel to other similar rows of used automobile tire portions (not shown in FIG. 1B).

For clarity of illustration, three used automobile tire portions in one row are identified in FIG. 1C by reference characters 14A, 14B, 14C, and three used automobile tire portions in an adjacent row are identified by reference characters 14D, 14E, and 14F. As can be seen in FIG. 1C, to form a conventional blasting mat, the used automobile tire portions typically are arranged on a generally flat surface in rows with alternating orientations, the used automobile tires each defining a "u" in one row that is oriented in an opposite direction relative to the used automobile tire portion(s) in the row beside it. There is some overlap of the tire portions. It will be understood that the used automobile tire portions 14, as illustrated in FIG. 1C, are each conventionally positioned in the row on the flat surface on the longitudinally cut edge of the tread part (i.e., as cut along center line 12), with a sidewall part 15 thereof (FIG. 1B) facing upwardly, and a tread part 16 (FIG. 1A) located substantially vertical. Typically, a number of parallel rows are arranged in this way, to form an uncompressed body. The used automobile tire portions are connected together by generally horizontally-positioned cables (not shown in FIGS. 1A-1C) drawn through holes formed in the used automobile tire portions.

The automobile tire portions 14, thus arranged into several parallel rows, are then compressed to form the prior art blasting mat (not shown). The automobile tire portions are held together under such pressure by an arrangement of the cables that are drawn through the automobile tire portions, and by clamps (not shown) on the cables to engage the used automobile tire portions.

Alternatively, the prior art blasting mat may be made of used truck tire portions 17.

In FIG. 1D, the typical used truck tire portion 17 is illustrated. As is well known in the art, the used truck tire portion 17 is a tread part 18 of the used truck tire. Sidewalls of the truck tire (not shown in FIG. 1D) typically are not included in the used truck tire portions 17. Those skilled in the art would appreciate that the tread part is cut from the used truck tire, and the sidewall part of the truck tire may be recycled. The length of each of the tread parts 18 may be any suitable length.

To form a blasting mat of the prior art (not shown), the used truck tire portions may be arranged into rows. Conventionally, the used truck tire portions 17 are positioned on their edges respectively, so that the treads of each are substantially vertical. For clarity of illustration, the used truck tire portions in FIG. 1E arranged on their edges in the row "R" are identified by reference characters 17A, 17B, and 17C. (As will be described, embodiments of the invention are illustrated in the balance of the attached drawings.)

To form a conventional blasting mat using used truck tire portions, a number of parallel rows of used truck tire portions are assembled, cables are drawn through the used truck tire portions, and then the body so assembled is compressed, to form another version of the prior art blasting mat. As in the process of forming the conventional blasting mat that includes portions of used automobile tires, in order to keep the used truck tire portions compressed, suitable clamps are positioned on the cables on one side of the completed body, to hold the used truck tire portions under compression.

Typically, and as described above, the blasting mats of the prior art are made of portions of used automobile tires, or alternatively, they may be made of portions of used truck tires. The prior art blasting mats typically do not include both automobile tire portions and truck tire portions. Also, in the prior art, the blasting mat is conventionally formed by compressing the entire body once, in a horizontal direction, and clamps are secured to the cables, to keep the entire body subjected to the same pressure.

As a result, in the prior art, the typical blasting mat has approximately the same density throughout. However, the typical blasting mat is relatively large, to provide satisfactory protection from the blast. Because of this, the conventional blasting mats are relatively heavy, with the consequence that they are relatively difficult to move, and cumbersome to locate in a preselected location relative to a proposed blast.

SUMMARY OF THE INVENTION

There is a need for a blasting mat that overcomes or mitigates one or more of the disadvantages or defects of the prior art. Such disadvantages or defects are not necessarily included in those listed above.

In its broad aspect, the invention provides a blasting mat including a number of resilient elements arranged in a number of parallel rows that are located in a number of predetermined regions of the blasting mat. The resilient elements in each region are respectively subjected to a preselected compression pressure to cause each region to have a respective preselected density within a range of preselected densities. The preselected density of at least a second selected one of the regions is greater than the preselected density of at least a first selected one of the regions.

In another of its aspects, the invention provides a blasting mat including a first region having a number of first resilient elements arranged in a number of first resilient element rows. The first resilient elements are compressed at a first preselected pressure to provide the first region with a first density that is within a range of preselected first densities. The blasting mat also includes a second region having a number of second resilient elements arranged in a plurality of second resilient element rows. The second resilient elements are compressed at a second preselected pressure to provide the second region with a second density that is within a range of preselected second densities that are greater than the first density.

In yet another of its aspects, the invention provides a method of forming a blasting mat, the method including providing one or more layers of a first composite material, and providing one or more layers of rubber material. The layers of the first composite material and the rubber material are heated to a working temperature. A first region of the layers of the first composite material and the rubber material are subjected to a first compression pressure, to form the first region of the blasting mat with a predetermined first density. A second region of the layers of the first composite material and the rubber material are subjected to a second compression pressure, to form the second region of the blasting mat with a predetermined second density.

BRIEF DESCRIPTION OF THE DRAWINGS

The invention will be better understood with reference to the attached drawings, in which.

DETAILED DESCRIPTION

Figure 1A:
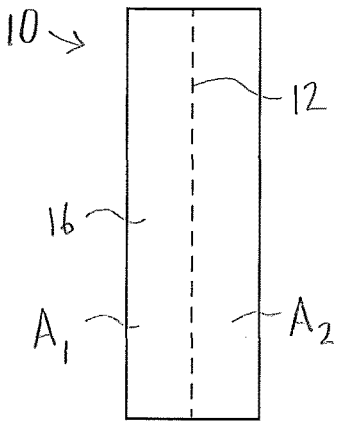
FIG. 1A (Prior Art)
FIG. 1A (also described previously) is an end view of a used automobile tire, before it is cut into two halves thereof.
Figure 1B:
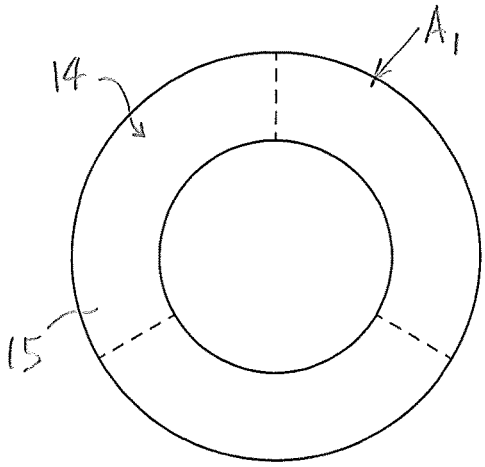
FIG. 1B (Prior Art)
FIG. 1B (also described previously) is a side view of one half of the used automobile tire of FIG. 1A.
Figure 1C:
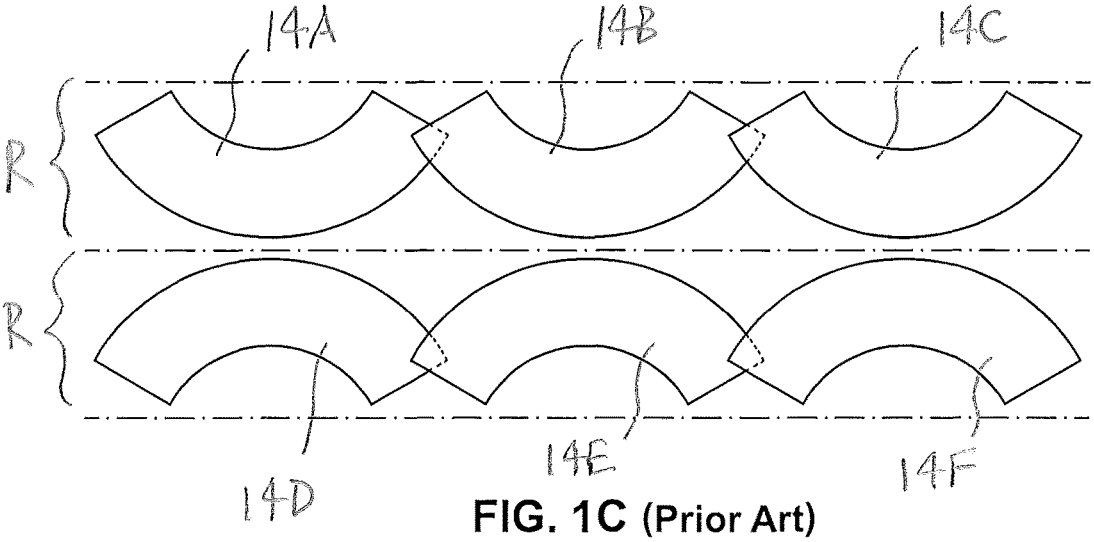
FIG. 1C (Prior Art)
FIG. 1C (also described previously) is a top view of a number of used automobile tire portions positioned on their sides, and located in a row prior to compression thereof.
Figure 1D:
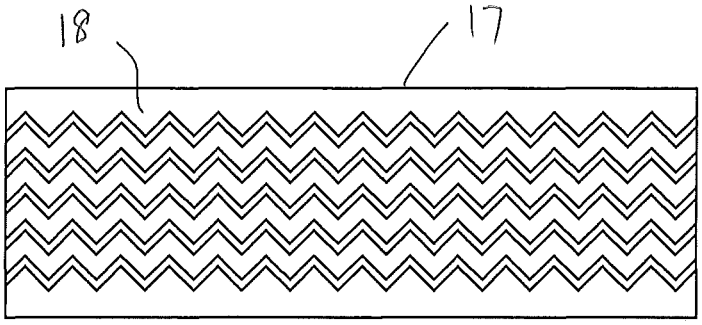
FIG. 1D (Prior Art)
FIG. 1D (also described previously) is a top view of a used truck tire portion, drawn at a larger scale.
Figure 1E:
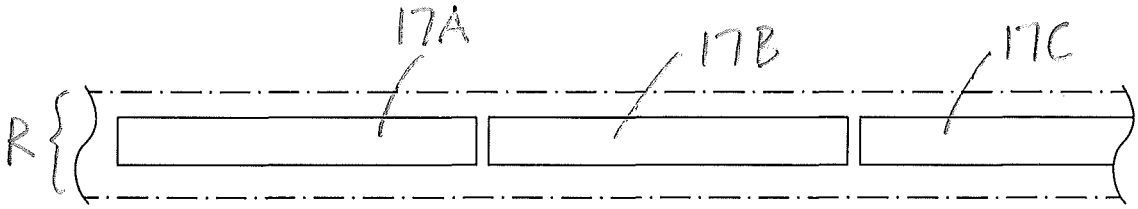
FIG. 1E (Prior Art)
FIG. 1E (also described previously) is a top view of a number of used truck tire portions positioned on their sides, and located in a row prior to compression thereof, drawn at a smaller scale.

In the attached drawings, like reference numerals designate corresponding elements throughout. In particular, to simplify the description, the reference numerals previously used in FIGS. 1A-1E are used again in connection with the description of the invention hereinafter, except that each such reference numeral is raised by 100 (or by whole number multiples thereof, as the case may be), where the elements correspond to one or more of the elements illustrated in FIGS. 1A-1E.

Reference is made to FIGS. 2A-4 to describe an embodiment of the blasting mat of the invention indicated generally by the numeral 120. In one embodiment, the blasting mat 120 preferably includes a number of resilient elements 128 arranged in a number of parallel rows 124 forming a blasting mat body 125 that are located in a number of predetermined regions 126 of the blasting mat body 125 (FIG. 2E). As will be described, the resilient elements 128 in each of the regions 126 preferably are respectively subjected to a preselected compression pressure. The differences in the pressure that is applied cause each of the regions 126 to have a respective preselected density within a range of preselected densities. For instance, where the blasting mat includes a first region 148 and a second region 158 (FIG. 2A), the preselected density of the second region 158 preferably is greater than the preselected density of the first region 148.

Figure 2A:
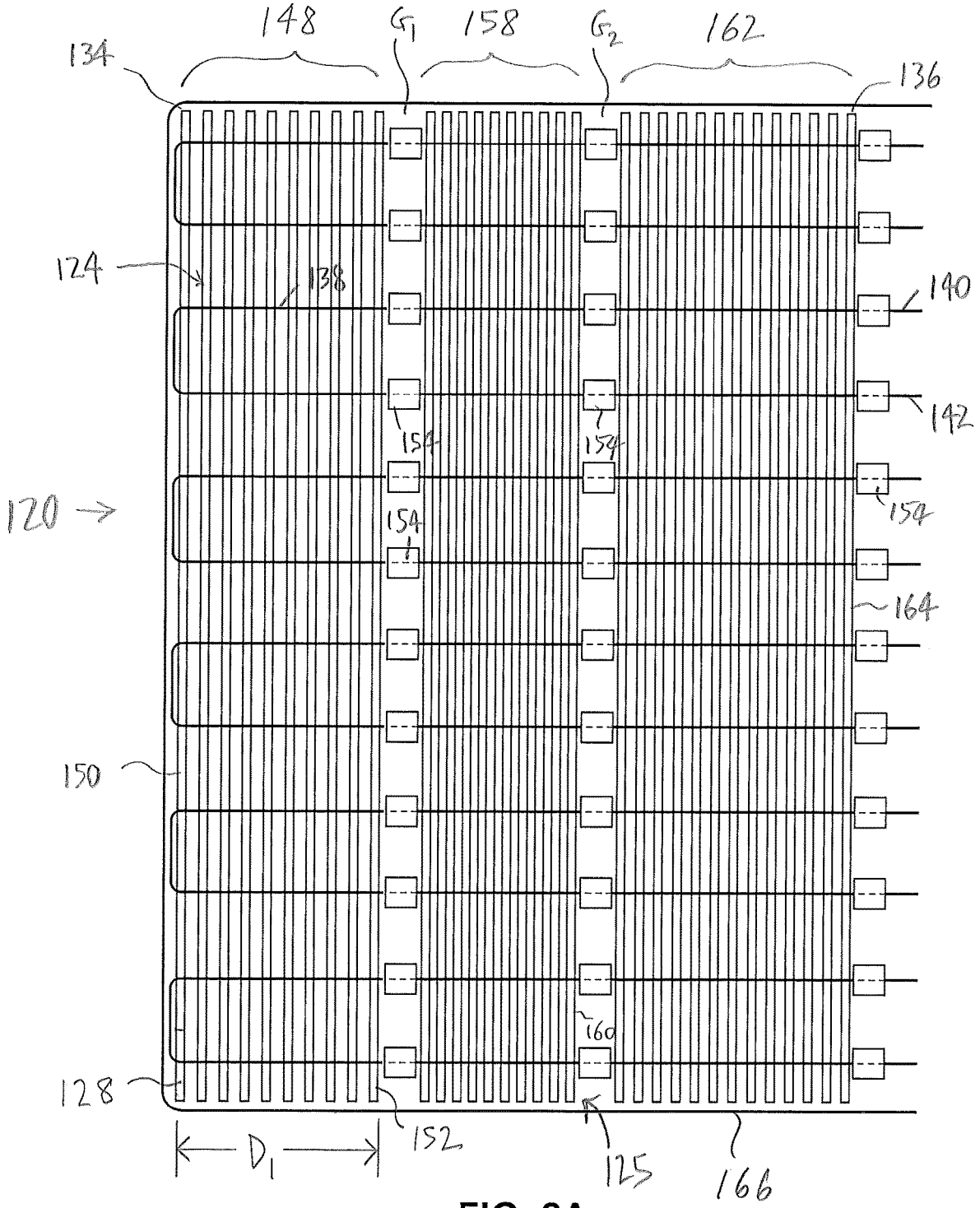
FIG. 2A is a schematic illustration of a top view of an embodiment of a blasting mat of the invention, drawn at a smaller scale.

It will be understood that FIGS. 2A-3A are schematic illustrations. For instance, for clarity of illustration, only one resilient element 128 is shown in FIG. 2A. The rows 124 of the resilient elements 128 are schematically represented by elongate rectangles. Also, a number of elements of the blasting mat 120 are omitted from FIGS. 2A-3A, for clarity of illustration.

As noted above, one of the problems encountered with the prior art blasting mats is their weight. The blasting mat 120 of the invention has the advantage that one or more regions thereof are more dense than one or more other regions thereof. The blasting mat 120 preferably is formed so that a region thereof that is located in the blasting mat body so that it is positionable to be proximal to a blast (e.g., a region that is centrally located in the blasting mat body) is more dense than the other regions of the blasting mat body. Accordingly, the blasting mat of the invention is as effective to limit the movement of ground due to a blast as the prior art blasting mats, but achieves this even though the blasting mat of the invention weighs less overall than a comparable blasting mat of the prior art.

It will be understood that the blasting mat 120 may include any suitable number of second regions 158 in which the density thereof is greater (compared to the density of the first regions 148), and also may include any suitable number of first regions 148 in which the density thereof is lesser (compared to the density of the second regions 158). Those skilled in the art would appreciate that additional regions having different densities may be formed in the blasting mat body 125. As noted above, it is preferred that the locations of the regions (e.g., the first and second regions) on the body 125 are predetermined. The areas of the regions (e.g., the first and second regions) are predetermined in order to be suitable for the purposes thereof.

Those skilled in the art would appreciate that the resilient elements 128 may be made of any suitable resilient material (s). As will be described, the resilient elements 128 may be, for example, portions of automobile tires, or portions of truck tires, or both.

Figure 2B:
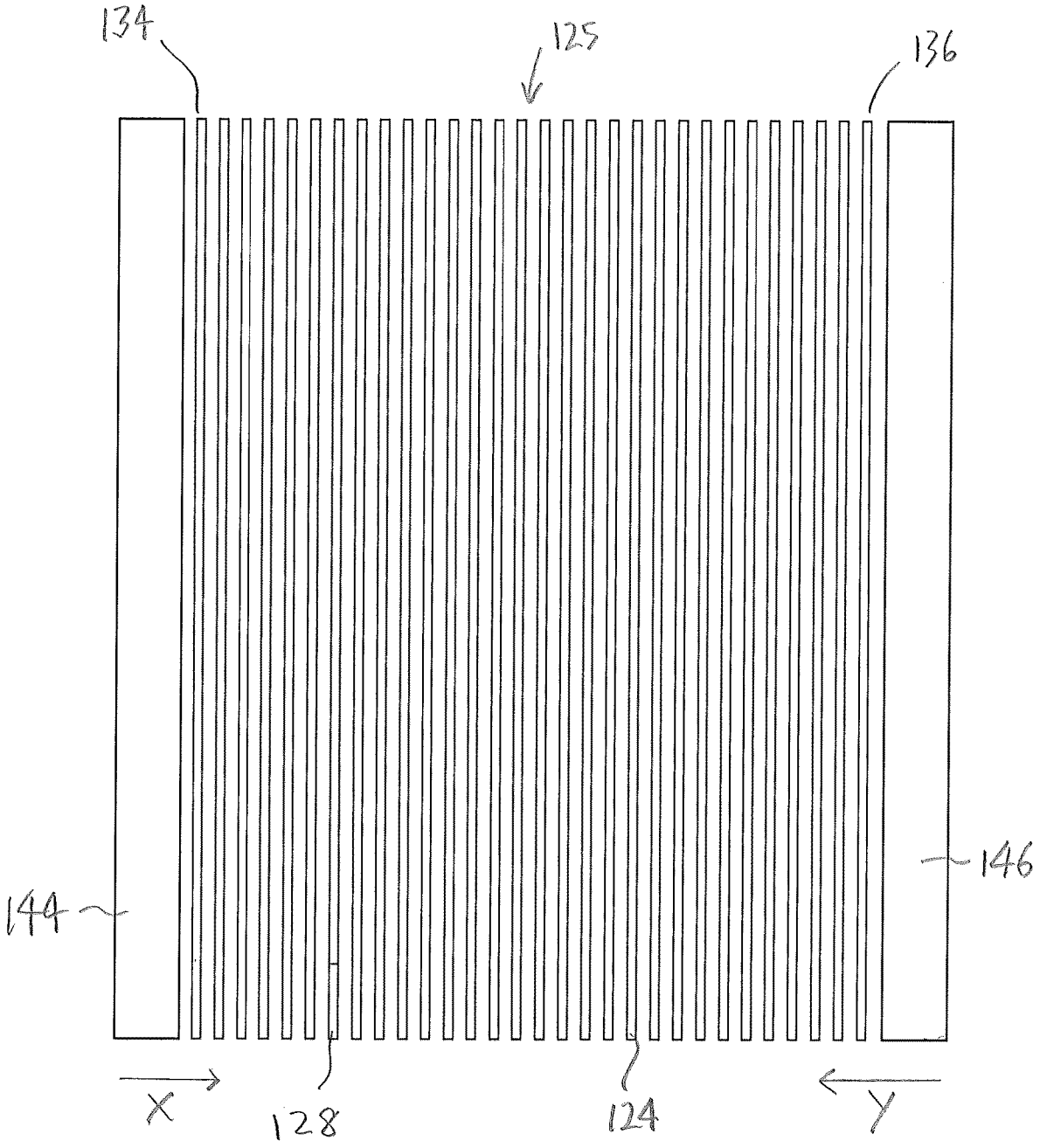
FIG. 2B is a schematic illustration of resilient elements arranged in parallel rows to form a body of the blasting mat, prior to compression thereof.

The invention includes a method of forming the blasting mat 120. One embodiment of the method of forming the blasting mat 120 that is shown in FIG. 2A is schematically illustrated in FIGS. 2B-2E. In one embodiment, the method includes, first, providing a number of the resilient elements 128. As is schematically illustrated in FIG. 2B, the resilient elements 128 preferably are arranged in a number of substantially parallel rows 124 to provide the blasting mat body 125 extending between a first end 134 and a second end 136 thereof. It will be understood that the resilient elements 128 are positioned in the substantially parallel rows 124 on a generally flat surface (not shown).

Preferably, a number of cables 138 are drawn through holes (not shown) that are formed in the resilient elements 128 respectively (FIG. 2A). For clarity of illustration, the cables 138 are omitted from FIGS. 2B and 2C.

Each of the cables 138 extends between two free ends 140, 142 thereof (FIG. 2A). As shown in FIG. 2B, the free ends 140, 142 of each of the cables 138 are located at the second end 136 of the blasting mat body 125 after the cables 138 are drawn through the holes to connect the resilient elements 128 together (FIG. 2A).

It will be understood that the arrangement or pattern of cables as illustrated in FIGS. 2A, 2D, 2E, 3A, and 3B is exemplary only. Those skilled in the art would be aware that the cables may be arranged in any suitable pattern in or on the blasting mat body. It will also be understood that the cables may have any suitable diameter, and may or may not be coated. The holes that are formed in the resilient elements are sized to receive the cables that are selected for use.

Figure 2C:
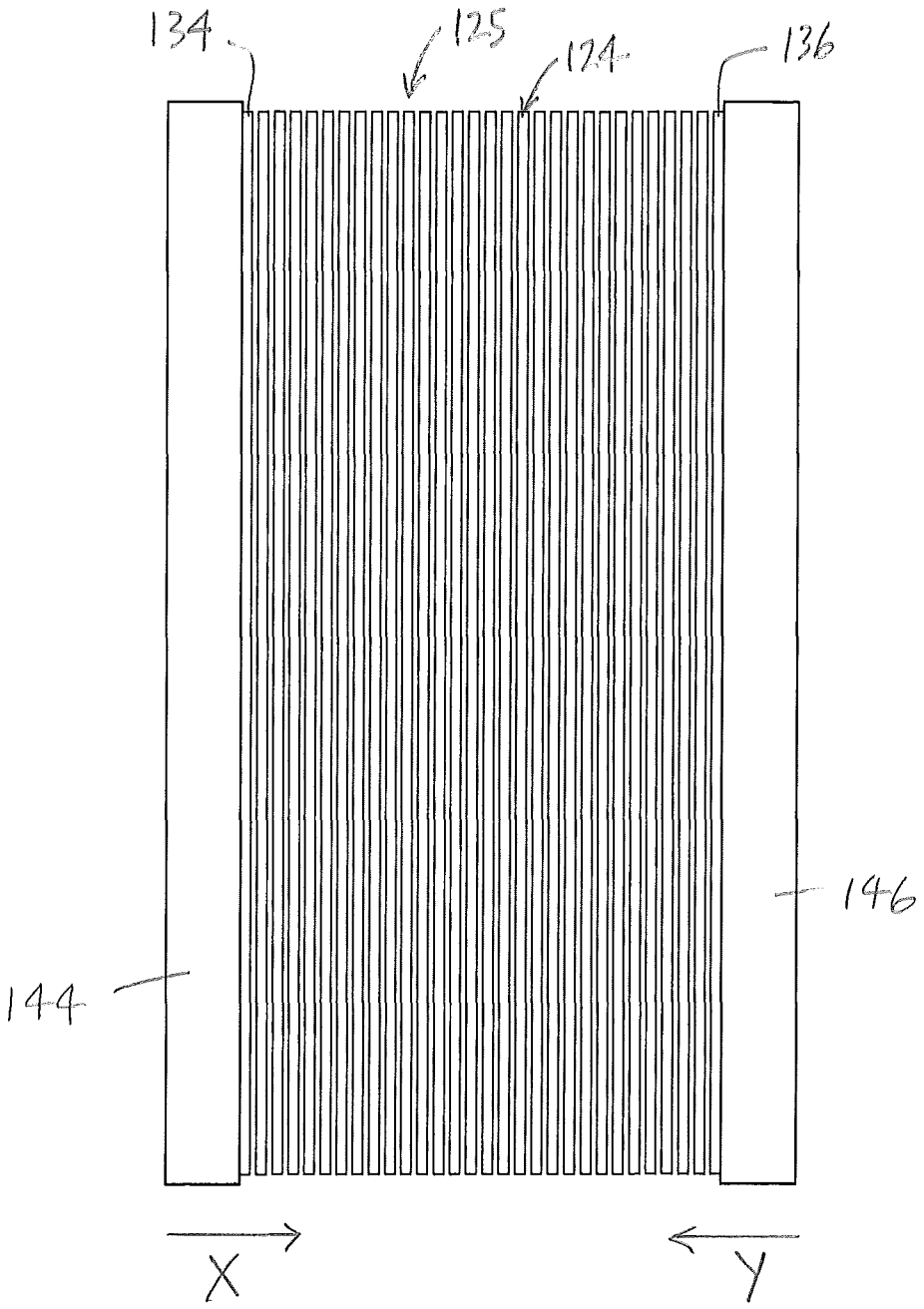
FIG. 2C is a schematic illustration of the resilient elements of FIG. 2B subjected to compression.
Figure 2D:
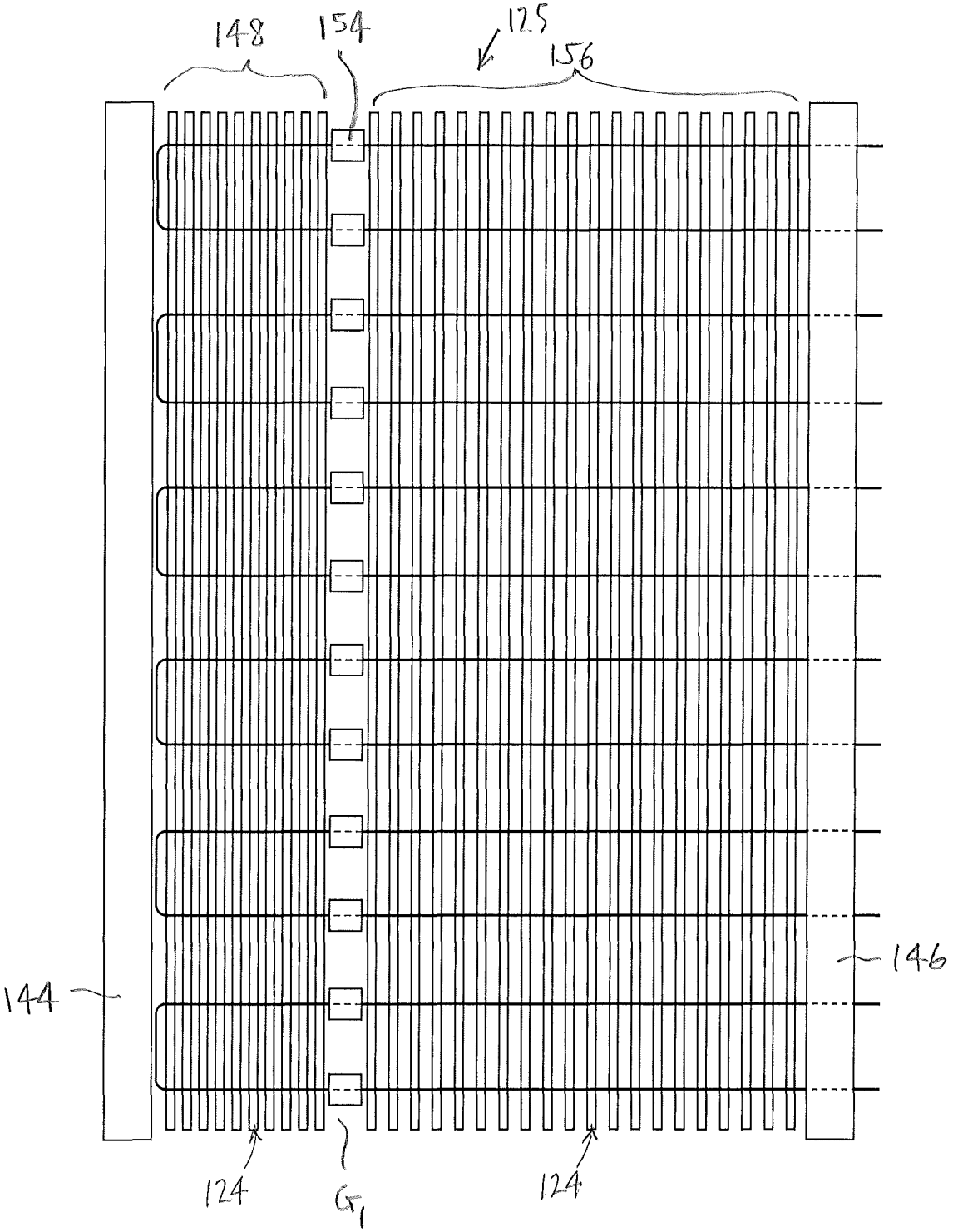
FIG. 2D is a schematic illustration showing the blasting mat body partly formed, in which the resilient elements in a first region of the blasting mat body are maintained in compression by clamps secured to the cables at a first interior row of the first region.
Figure 2E:
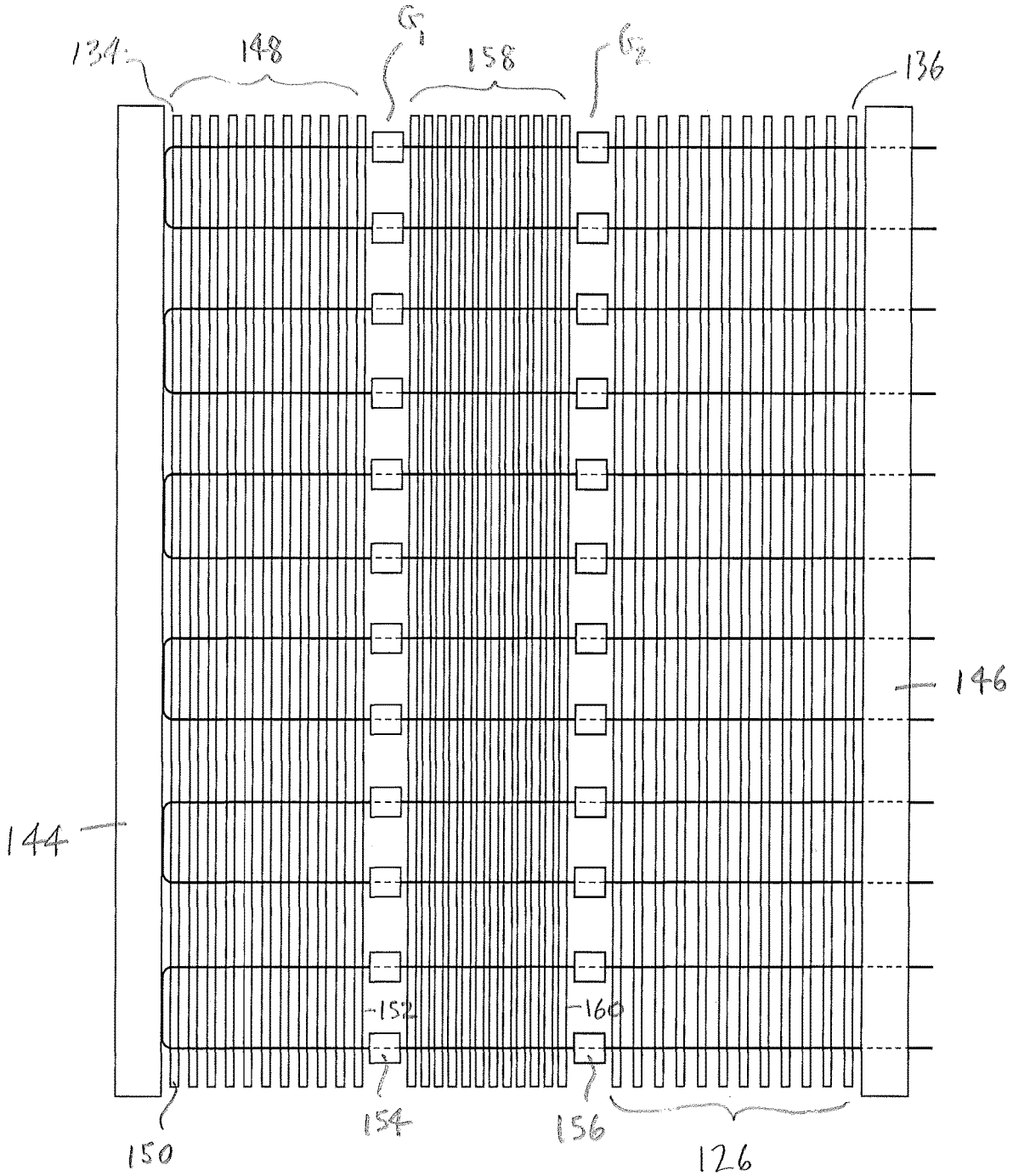
FIG. 2E is a schematic illustration showing the blasting mat body further formed, in which the resilient elements in a second region of the blasting mat body are maintained in compression by clamps secured to the cables at a second interior row.
Figure 3A:
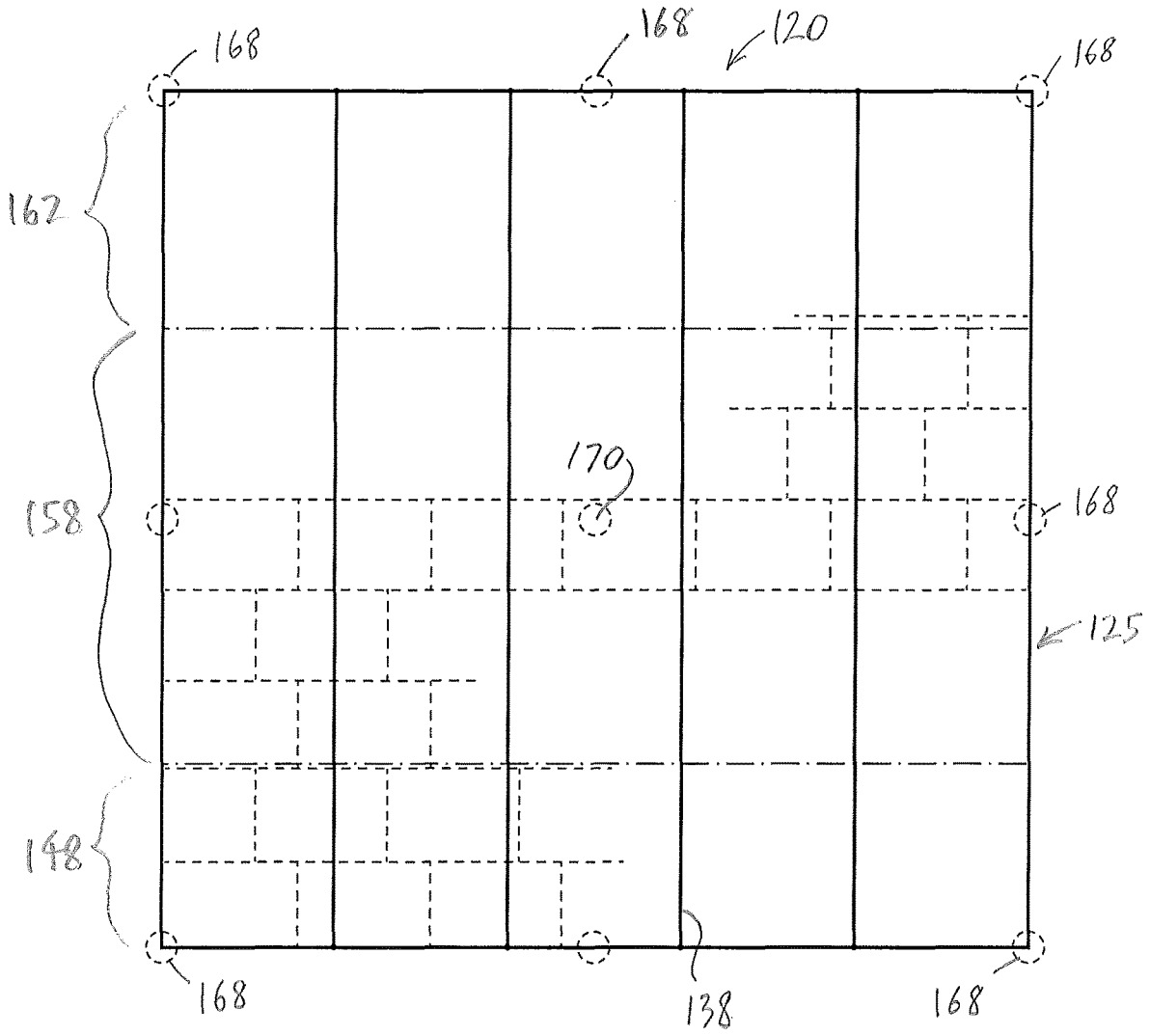
FIG. 3A is a schematic illustration of another embodiment of the blasting mat of the invention, drawn at a smaller scale.
Figure 3B:
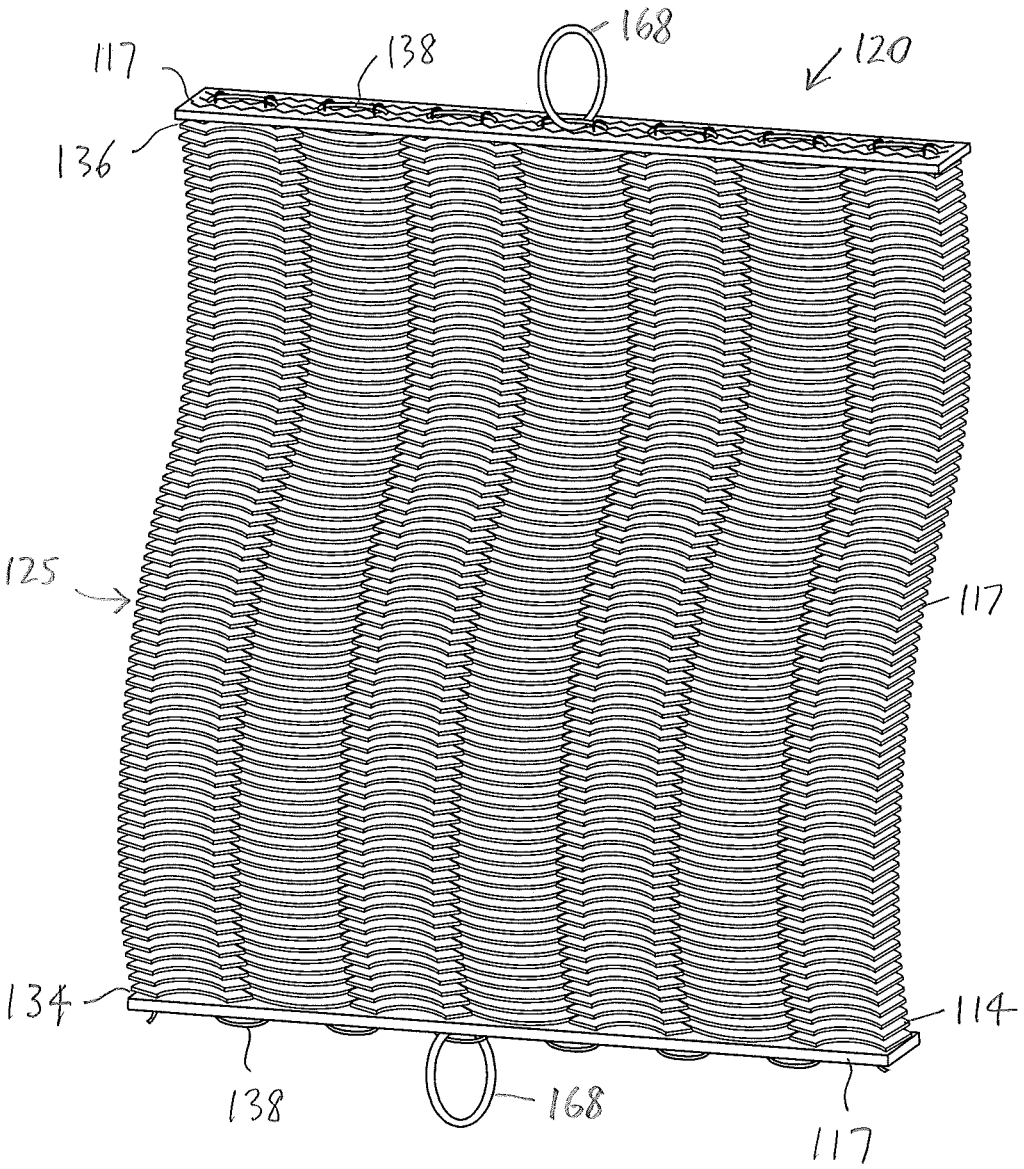
FIG. 3B is an isometric view of another embodiment of the blasting mat of the invention, drawn at a smaller scale.

FIGS. 2B-2E show the steps taken in forming one embodiment of the blasting mat 120 of the invention, the blasting mat 120 being shown in a generally assembled form in FIG. 2A, and also being shown in a completed form in FIG. 3B. As can be seen in FIG. 3B, the cables at the ends of the blasting mat body 125 preferably are bent into the blasting mat body 125 at the second end 136, or otherwise dealt with to provide the finished blasting mat 120.

As can be seen in FIG. 2B, in order to compress the blasting mat body 125, the blasting mat body 125 preferably is positioned between two plates 144, 146. As indicated by arrows "X" and "Y" in FIG. 2B, the body 125 preferably is compressed between the plates 144, 146. One or both of the plates 144, 146 is pushed against the body 125 by a suitable ram (not shown), e.g., a large hydraulic ram. It will be understood that, alternatively, both of the plates 144, 146 may be urged against the body 125, e.g., by two separate rams. It will be understood that, as illustrated, the resilient elements 128 forming the blasting mat body 125 preferably are positioned on a substantially flat surface, and the compression of the resilient elements 128 between the plates 144, 146 is directed substantially horizontally. Preferably, the resilient elements 128 are compressed to a preselected first pressure (FIG. 2C).

As will be described, the body 125 preferably is compressed more than once, in order to provide the blasting mat 120, at the completion of the process, with two or more regions thereof that have different densities.

In FIG. 2C, the blasting mat body 125 is shown compressed, in a first compression step, between the two plates 144, 146. The plates 144, 146 apply pressure inwardly, as indicated by arrows "X" and "Y" in FIG. 2C.

While the resilient elements 128 in the first region 148 of the blasting mat body 125 extending between a first exterior row 150 at the first end 134 and a first interior row 152 located a first distance "$D_1$" from the first end 134 are compressed at the first pressure, clamps 154 preferably are secured to the cables 138 at the first interior row 152. As schematically illustrated in FIG. 2D, the clamps 154 preferably engage the resilient elements 128 that are positioned in the first interior row 152, to keep the resilient elements 128 in the first region 148 subjected to the preselected first pressure.

It will be understood that the blasting mat body 125 and the plates 144, 146 are shown in FIG. 2D at a point in the process of the invention after the clamps 154 are secured at the first interior row 152, and one or both of the plates 144, 146 are moved outwardly, so that an unsecured portion 156 of the body 125 (i.e., the portion of the body 125 not included in the first region 148) is temporarily not subjected to pressure.

It will also be understood that the gap "$G_1$" illustrated in FIGS. 2A, 2D, and 2E is exaggerated, for clarity of illustration.

As schematically illustrated in FIG. 2E, after the first region 148 has been formed, the blasting mat body 125 preferably is subjected to a greater pressure, preferably, a preselected second pressure, to form a second region 158. In FIG. 2E, the plates 144, 146 are shown compressing the resilient elements 128 therebetween, as indicated by arrows "X", "Y".

While the resilient elements 128 in the second region 158 of the blasting mat body 125 extending between the first interior row 152 and a second row 160 located a second distance "$D_2$" from the first end 134 are compressed at the second pressure, additional clamps 154 preferably are secured to the cables 138 at the second row 160 to engage the resilient elements 128 that are positioned in the second row 160. As can be seen in FIG. 2E, the clamps 154 preferably keep the resilient elements 128 in the second region 158 subjected to the preselected second pressure. As will be described, the second pressure preferably is greater than the first pressure.

As can be seen in FIG. 2E, the second region 158 thus formed is located at a preselected location relative to the first and second ends 134, 136 of the blasting mat body 125.

It will be understood that the gap "$G_2$" shown in FIGS. 2A and 2E is exaggerated, for clarity of illustration.

From the foregoing, it can be seen that, in order to compress the second region 158 at the preselected second pressure, the entire blasting mat body 125 is compressed at that pressure. Those skilled in the art would appreciate that, although the first region 148 is thus temporarily compressed to the preselected second pressure, the first region 148 does not remain compressed at that pressure. Because the first region 148 is compressed to the preselected second pressure after the first region 148 has been formed, and also because of the resilience of the resilient elements 128 located in the first region 148, after the second region 158 has been formed and the body 125 is not subject to the preselected second pressure, the region 148 is only subjected to the preselected first pressure, due to the clamps 138.

The embodiment of the blasting mat 120 illustrated in FIG. 2A also includes a third region 162 (FIG. 2A). It will be understood that the third region 162 preferably is formed in substantially the same way as the first and second regions 148, 158, except that the third region 162 is formed after the second region 158 has been formed.

To form the third region 162, the body 125 is compressed between the plates 144, 146, at the preselected pressure for such region. For instance, if the third region 162 is intended to have a density similar to the density of the first region 148, then, at this point in the process, the blasting mat body 125 may be subjected to the preselected first pressure. While the blasting mat body 125 is subjected to such pressure between the plates 144, 146, additional clamps 154 preferably are secured to the cables 138 and engaged with a second exterior row 164 of the resilient elements 128, to keep the third region 162 subjected to the preselected first pressure (FIG. 2A).

It will be understood that, although the entire body 125 is subjected to the preselected pressure for the third region 162, this compression does not permanently affect the pressures to which the first and second regions 148, 158 are already subject, once the clamps 154 engaging the second exterior row 164 have been installed, and the pressure applied to form the third region 162 is not applied by the plates 144, 146.

It will be understood that, in this example, because the third region 162 is subjected to the first preselected pressure when the third region 162 is formed, once the clamps 154 engaging the exterior row 164 are in place, the resilient elements 128 in the third region 162 have a density that is approximately the same as the density of the first region 148. From the foregoing, it can be seen that the blasting mat 120 of the invention, in the example illustrated in FIG. 2A, has two relatively lower density regions (i.e., the first and third regions 148, 162) located on both sides of the higher density region (i.e., the second region 148).

Accordingly, in this example, the second region 158 is located in a predetermined location relative to the first and third regions 148, 162, i.e., the second region 158 is generally centered in the blasting mat body 125. Those skilled in the art would appreciate that the blasting mat 120 illustrated in FIG. 2A may be used to suppress ground movement by positioning the blasting mat 120 to register or align the second region 158 with the center of the blast area, so that the second region 158 may be utilized to minimize ground movement due to the blast. In use, the location of the second region 158 relative to the ends 134, 136 of the blasting mat body 125 may assisting in positioning the blasting mat 120 properly relative to a proposed blast.

Those skilled in the art would also appreciate that the pressures (low, and high) to which the body is subjected to form the blasting mat may vary widely. For instance, the pressures applied to form the blasting mat 120 may vary between approximately 600 psi and approximately 800 psi. However, the pressures applied to compress the resilient elements may reach approximately 1,500 psi.

In one embodiment, the resilient elements 128 preferably are used vehicle tire segments. For instance, the used vehicle tire segments may be preformed portions 114 of used automobile tires, and/or preformed portions 117 of used truck tires (FIG. 3B), as will be described.

From the foregoing, it can be seen that the used truck tire portions 117 are more readily pressed tightly together than the used automobile tire portions 114, due to the differences in shapes thereof. The used truck tire portions 117 are generally planar, as they do not include sidewalls, and once compressed, the used truck tire portions 117 do not tend to rebound, to the extent that the used automobile tire portions 114 do. In addition, the materials in the used truck tire portions 117 tend to be more dense than the materials of the used automobile tire portions 114.

Accordingly, in one embodiment, the used truck tire portions 117 preferably are positioned in the region of the body 125 that is intended to have a higher density, e.g., the second region 158, in the example illustrated in FIG. 2A. Similarly, the used automobile tire portions 114 preferably are positioned in the regions of the body 125 that are intended to have a lower density, e.g., the first and third regions 148, 162 in the example illustrated in FIG. 2A. Accordingly, in one embodiment, at least a first portion of the used vehicle tire segments in the first region 148 preferably include the preformed portions 114 of automobile tires, each of the preformed portions 114 having a sidewall part of the automobile tire and a tread part of the automobile tire. Also, at least a second portion of the used vehicle tire segments in the second region 158 preferably include preformed portions 117 of truck tires, each of the preformed portions 117 having a part of tread thereof.

In addition, the preformed portions of the used truck tires 117 may be positioned at the first and second ends 134, 136 of the blasting mat body 125, to strengthen the blasting mat body 125 (FIG. 3B).

An embodiment of the blasting mat 120 is illustrated in FIG. 3B. As can be seen in FIG. 3B, in one embodiment, it is preferred that one or more preformed portions 117 of truck tires are positioned at the first end 134. Similarly, it is preferred that one or more preformed portions 117 of used truck tires are positioned at the second end 136 of the blasting mat body 125. Those skilled in the art would appreciate that positioning one or more preformed portions 117 of used truck tires at the ends 134, 136 of the blasting mat body 125 tends to provide a generally more cohesive body 125.

As can be seen in FIG. 2A, in one embodiment, the blasting mat 120 preferably also includes an outer cable 166 drawn around an outer perimeter of the body 125, to strengthen the blasting mat 120 overall. It will be understood that, although the outer cable 166 as illustrated in FIG. 2A is shown positioned separately from the body 125, the outer cable 166 does engage the blasting mat body 125, to assist in holding the resilient elements together in one mass. The outer cable 166 is shown separately from the body 125 for clarity of illustration.

As can be seen in FIG. 3B, it is preferred that, in the completed blasting mat 120 (i.e., after the blasting mat body 125 has been compressed for the final time), the cables 138 preferably are formed at their ends so that the free ends thereof do not project outwardly from the body 125.

In one embodiment, one or more rings 168 preferably are secured to the blasting mat body 125, to facilitate movement of the blasting mat 120 (FIG. 3B). The rings 168 may also be used to secure the blasting mat 120 in a predetermined location in relation to one or more blast holes or boreholes in which explosive charges are positioned.

In use, the blasting mat 120 is positioned in the predetermined location relative to a ground surface of an area that is to be blasted. The ground surface may be generally horizontal, or sloped. In these cases, the blasting mat 120 is laid on the ground surface, after the blast holes are formed and explosive charges are positioned in the blast holes. As described above, the blasting mat 120 preferably is positioned on the ground surface so that the location thereon that is likely to be subjected to the most upheaval due to the blast is overlain by the more dense region(s) of the blasting mat body 125.

An embodiment of the blasting mat 120 is schematically illustrated in FIG. 3A. The first, second, and third regions 148, 158, and 162 are illustrated in FIG. 3A, for exemplary purposes. As can be seen in FIG. 3A, in one embodiment, the blasting mat 120 preferably includes an opening 170 that is provided in a preselected position on the blasting mat body 125, to permit access therethrough to an explosive charge when the blasting mat 120 is secured in a predetermined location relative to the explosive charge. For example, the opening 170 may be used for access to permit connection of an initiation device (not shown) with an explosive charge.

Figure 4:
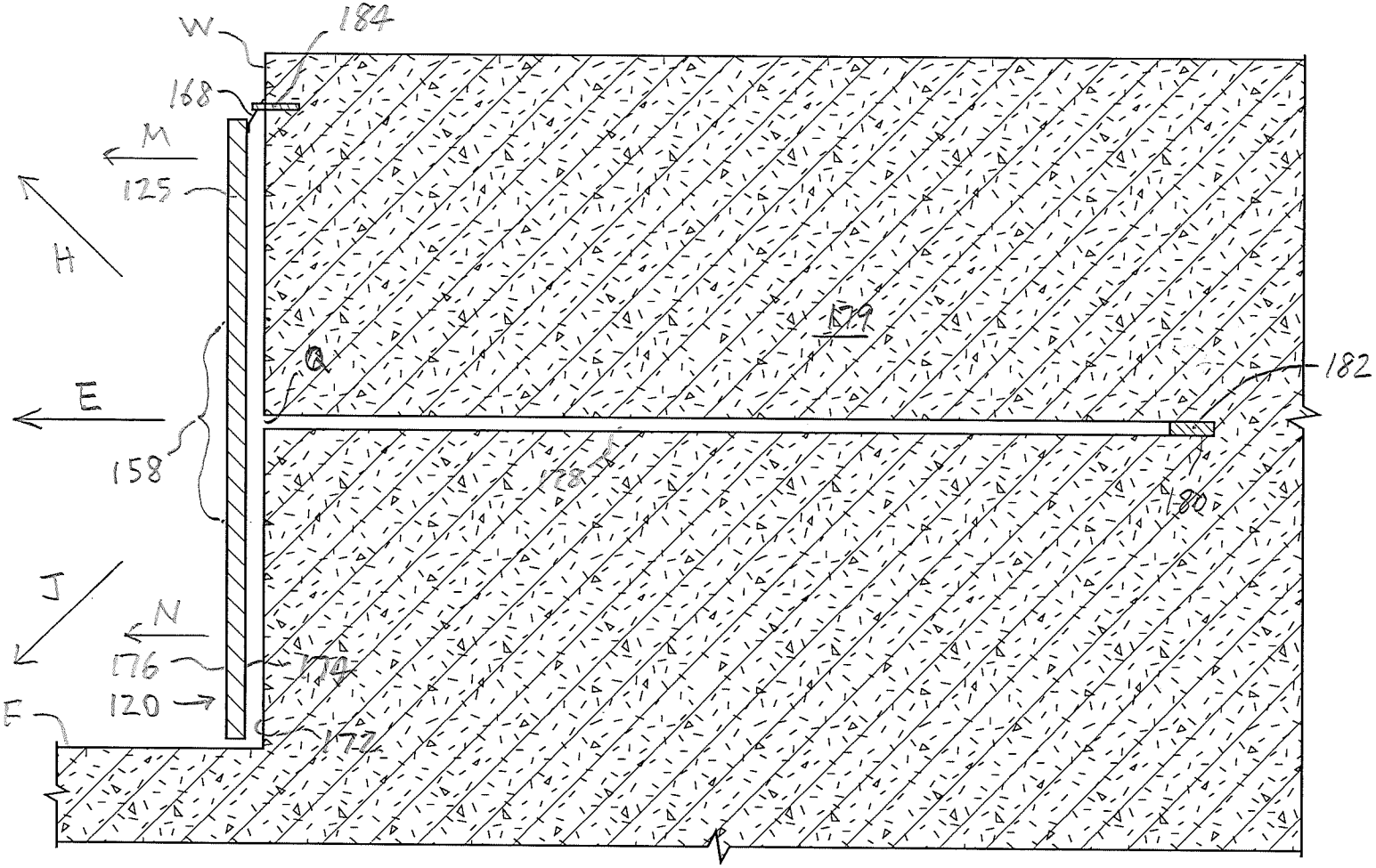
FIG. 4 is a side view of the blasting mat of FIG. 3A in which the blasting mat is located in a predetermined location adjacent to a ground surface, drawn at a smaller scale.

The blasting mat 120 may be used where the blasting mat is to be located in a substantially vertical position, as shown in FIG. 4. Alternatively, the blasting mat 120 may be laid on the ground to be blasted.

Those skilled in the art would appreciate that, in connection with a typical blast, several blast holes or boreholes may be drilled, and loaded with explosive charges. Only one blast hole is shown in FIG. 4 in order to simplify the description.

As can be seen in FIG. 4, a ground surface 172 to which the blasting mat 120 is adjacent may be a substantially vertical wall "W". It will be understood that the blasting mat 120 is shown in FIG. 4 as being spaced apart from the wall "W" and a floor "F" by offset distances that have been exaggerated in FIG. 4 for clarity of illustration. It will also be understood that, in use, an inner side 174 of the blasting mat body 125 preferably is engaged with the wall "W", and may also be engaged with, and partially supported by, the floor "F". The blasting mat body 125 has an outer side 176 opposed to the inner side 174.

Except for the offsets of the blasting mat 120 from the wall "W" and the floor "F", it will be understood that the blasting mat 120 is shown in the predetermined location thereof on the ground surface 172 in FIG. 4. Those skilled in the art would appreciate that the blasting mat 120 may be secured in its predetermined location by any suitable means.

Those skilled in the art would also appreciate that, before the blasting mat 120 is secured in its predetermined location, a borehole 178 is drilled in the ground 179 to a preselected location 180 (FIG. 4). As can be seen in FIG. 4, after the borehole 178 is formed, an explosive charge 182 is positioned at the selected location 180 in the ground 179. After the explosive charge 182 is positioned at the selected location 180, the blasting mat 120 is secured in a predetermined location relative to the borehole.

The borehole 178 intersects the wall "W" at an exit location "Q", as shown in FIG. 4. Those skilled in the art would appreciate that, upon detonation of the explosive, gases released from the explosive and fragments of the ground 179 that are broken upon detonation are expelled from the borehole 178 at or near the exit location "Q" at very high velocity. The blasting mat 120 is intended to contain or mitigate these undesirable consequences of a detonation, to the extent feasible, thereby limiting the risk of damage to people or objects located nearby or relatively short distances from the outer side 176 of the blasting mat body 125, with the blasting mat body 125 located between the ground surface 172 and such people or objects (not shown).

The general direction in which the gases and ground fragments exit the borehole (or the ground near the borehole) is indicated by arrow "E" in FIG. 4. However, those skilled in the art would appreciate that the gases and ground fragments may also exit the borehole 178 or the area proximal thereto at the exit location "Q" in the directions generally indicated by arrows "H" and "J". Also, parts of the ground surface 172 typically are moved outwardly upon detonation, as generally indicated in FIG. 4 by arrows "M" and "N". The gases and ground fragments moving at the highest velocity would be expected to be those travelling in the directions indicated by arrows "E", "H", and "J".

Preferably, the blasting mat 120 is positioned to locate the second region 158 centered on the exit location "Q", in which the protection provided by the blasting mat 120 is greater, because the second region 158 is more dense. The first and third regions 148, 162, are positioned further away from the borehole, in peripheral regions in which protection to a lesser extent may be adequate, the regions 148, 162 being less dense.

In FIG. 4, a spike 184 is illustrated, being shown as having been driven into the wall "W" near an upper end thereof. The spike 184 is shown at an enlarged size for clarity of illustration. As illustrated, a selected one of the rings 168 is positioned on the spike 184. It will be understood that a number of other spikes or similar devices (not shown) preferably are used, with the other rings 168, to hold the blasting mat 120 in the predetermined location thereof on the ground surface 172. In addition, it will also be understood that a number of the rings 168 of the blasting mat 120 would be required, with the spikes, to secure the blasting mat 120 in the predetermined location, and that only one of the rings 168 is illustrated in FIG. 4 for clarity of illustration.

As noted above, the resilient elements may be any suitable resilient elements. Those skilled in the art would be aware that suitable resilient elements may be, for example, elements other than used vehicle tire segments. Those skilled in the art would also appreciate that, when used vehicle tire segments are included in the blasting mat body, it is difficult to determine in advance whether the compressed used vehicle tire segments in a region of the blasting mat body 125 will ultimately have a specific density, due to the tendency of the used vehicle tire segments to rebound after compression is somewhat relaxed, when the clamps 154 are secured. This tendency is particularly pronounced where the portions of used automobile tires are used as the resilient elements.

Figure 5A:
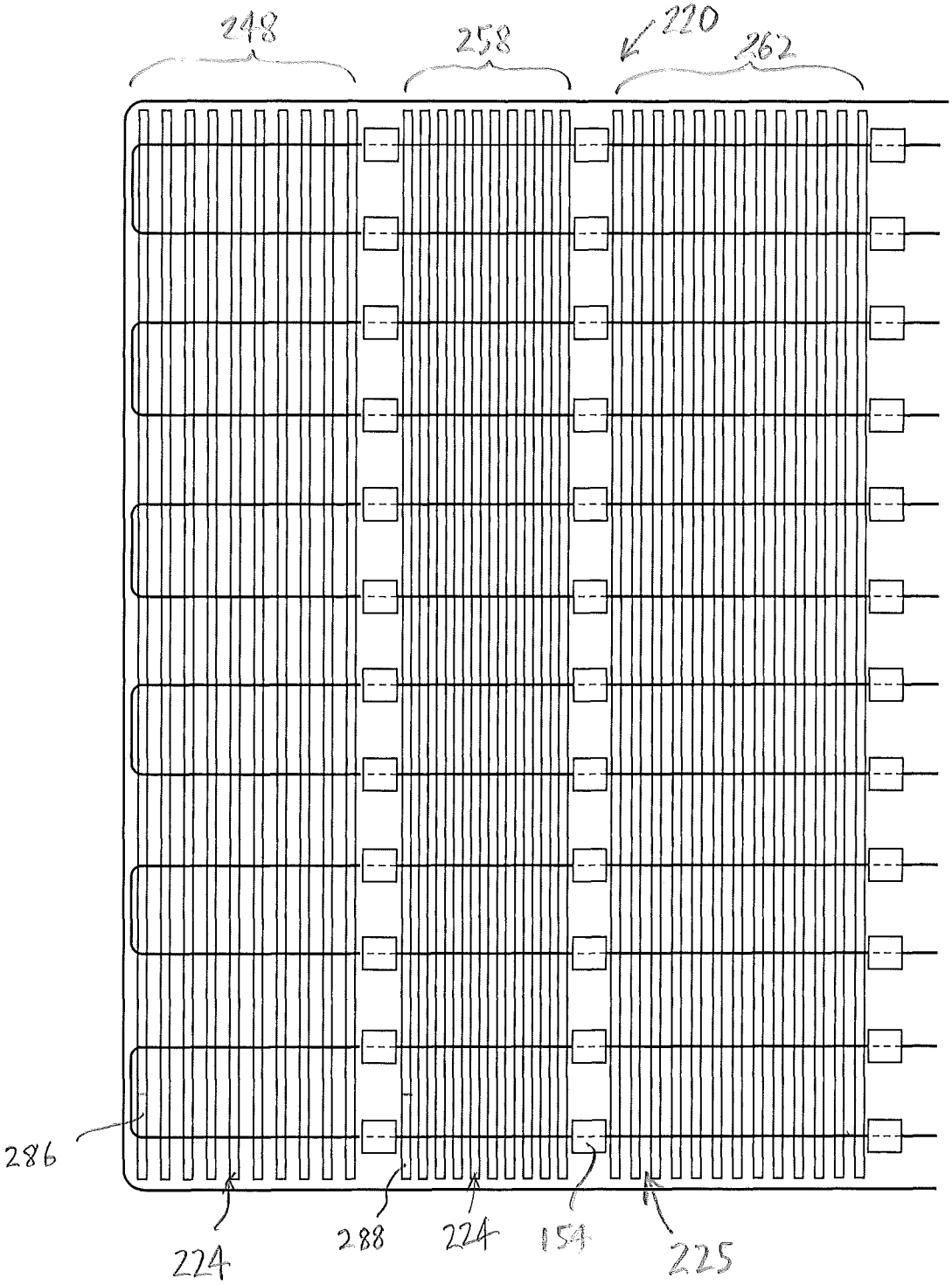
FIG. 5A is a schematic illustration of another embodiment of the blasting mat of the invention, drawn at a larger scale.
Figure 5B:
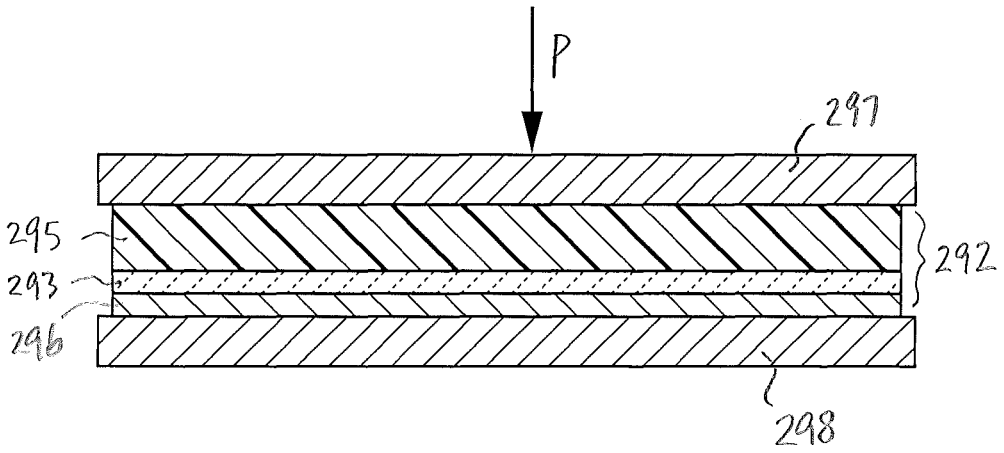
FIG. 5B is a cross-section of another embodiment of the blasting mat of the invention.
Figure 5C:
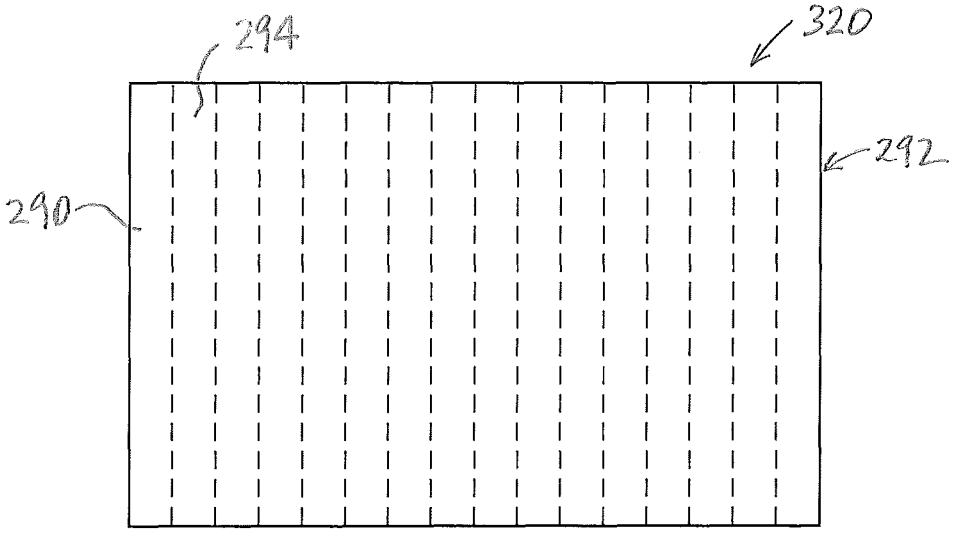
FIG. 5C is a top view of the blasting mat of FIG. 5B.

As noted above, the resilient elements may be any suitable elements. In alternative embodiments of the blasting mat of the invention, other materials are used as resilient elements. For instance, another embodiment of the blasting mat body 225 included in a blasting mat 220 preferably includes first, second, and third regions 248, 258, 262 respectively. The blasting mat body 225 preferably includes first resilient elements 286 located in the first region 248, and second resilient elements 288 located in the second region 258. The first and second resilient elements 286, 288 are arranged in rows 224 (FIG. 5A). As will be described, it is preferred that the first resilient elements 286 are formed from a first part 290 of a body 292 that includes one or more layers of a preselected first composite material having a predetermined first composite material density (FIGS. 5B, 5C).

As will also be described, the first resilient elements 286 in the first part of the body 292 preferably are subjected to a first compression pressure to provide the layer(s) of the preselected first composite material having the predetermined first density. Preferably, the second resilient elements 288 are formed from a second part 294 of the body 292 that includes one or more layers of the preselected first composite material having a predetermined second composite material density (FIGS. 5B, 5C). It is preferred that the differences in density are due to the materials in the different parts 290, 294 being subjected to different pressures, when the body 292 is formed.

Accordingly, the second resilient elements 288 in the second part of the body preferably are subjected to a second compression pressure to provide the layer(s) of the preselected first composite material having the predetermined second density.

It will be understood that the arrangement or pattern of cables as illustrated in FIG. 5A is exemplary only. Those skilled in the art would be aware that the cables may be arranged in any suitable pattern in or on the blasting mat body.

As can be seen in FIG. 5B, the body 292 preferably includes one or more composite materials, in layers. Those skilled in the art would appreciate that the body 292 may include any suitable number of composite materials. It is preferred that the body 292 includes rubber 295 and one or more composite materials, e.g., poly-paraphenylene terephthalamide (Kevlar™), carbon fiber, and/or basalt. As an example, the body 292 illustrated in FIG. 5B also includes a second composite material 296.

It is also preferred that the body 292 is formed using compression molding, in which the body 292 is subjected to heat and pressure. In the method of the invention herein, it is preferred that more than one region of the body 292 is subject to one or more pressures respectively, to form the one or more regions with different respective densities accordingly.

It will be understood that the pressure is applied substantially vertically, e.g., as indicated by arrow "P" in FIG. 5B. As can be seen in FIG. 5C, for example, the body 292 may include a number of parts thereof that have been subjected to different pressures. The pressure may be applied in any suitable manner. For example, in FIG. 5B, the body 292 is shown being compressed between upper and lower plates 297, 298.

From the foregoing, it can be seen that the body 292 may be formed with the first part or region 290 thereof, from which the first resilient elements are taken, and the second part or region 294, from which the second resilient elements are taken. As noted above, the first region 290 may be formed using a lower pressure, and the second region 294 may be formed using a relatively higher pressure. As a result, the first resilient elements have lower density, and the second resilient elements have higher density.

Accordingly, it is preferred that the first resilient elements 286 are cut from the first part 290, and may be further cut into pieces or fragments that are arranged into a plurality of parallel rows in the first region 248 of the blasting mat body 225 (FIG. 5A). Similarly, the second resilient elements 288 preferably are cut from the second part 294, and ultimately arranged into parallel rows in the second region 258. From the foregoing, it can be seen that additional resilient elements may be taken from other parts of the body 292, having suitable densities as required, and positioned in parallel rows in other regions of the blasting mat body 225 as needed. Preferably, the blasting mat body 225 is then compressed in more than one compression step as described above, and clamps 154 are applied as described above after each compression step, to provide the blasting mat body 225 that includes one or more regions of lower density, and one or more regions of higher density.

The third region 262 of the blasting mat body 225 may, for example, include the first resilient elements 286, compressed at the first preselected pressure, so that the third region 262 has a density that is substantially the same as the density of the first region 248.

With this embodiment of the method of the invention, the manufacturer can manufacture the body 292 with the densities thereof within narrow ranges that are predictable. Because the first and second resilient elements 286, 288 have densities that are known with some precision (i.e., prior to their compression when in the blasting mat body 225), the densities of the first, second, and third regions 248, 258, 262 of the blasting mat body 225 are accurately predictable.

In another alternative method of the invention, the body 292 may be used as the blasting mat 320 (FIG. 5C). In this method, as described above, the layers in the first part or region 290 of the body 292 are subjected to the first compression pressure, to form the first part or region 290 of the blasting mat body 292 with a predetermined first density. Next, the layers in the second part or region 294 are subjected to the second compression pressure, to form the second part or region 294 of the blasting mat body 292 with a predetermined second density. The pressures involved may be relatively high, e.g., up to approximately 10,000 psi.

It will be understood that a number of elements (e.g., rings, to facilitate moving the blasting mat 320) have been omitted from FIG. 5C.

As described above, the blasting mat 320 may be formed to include several regions having different densities than the first and second regions. As illustrated in FIG. 5C, the blasting mat 320 has a number of regions. Those skilled in the art would appreciate that the regions of the blasting mat 320 having different densities may have any suitable configurations. For example, the blasting mat 320 may be formed to have a more dense region defined by a radius from its center.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A blasting mat for covering a selected area of ground to be blasted, the blasting mat comprising:

a blasting mat body extending between first and second ends thereof and comprising a plurality of resilient elements arranged in a plurality of parallel rows that are located in a plurality of predetermined regions of the blasting mat body, said predetermined regions comprising at least first and second regions;

a plurality of cables drawn through holes in the resilient elements, to locate the resilient elements in the predetermined regions;

the resilient elements located in the first region being subjected to a preselected first compression pressure directed orthogonally to the ends of the first and second ends in the first region to compress the resilient elements in the first region to a first density that is within a range of preselected first densities;

a plurality of first clamps secured to the cables at selected locations thereon to keep the resilient elements in the first region subject to the first compression pressure;

the resilient elements located in the second region being subjected to a preselected second compression pressure directed orthogonally to the ends of the first and second ends in the second region to compress the resilient elements in the second region to a second density within a range of preselected second densities, the second density being greater than the first density;

a plurality of second clamps secured to the cables at additional selected locations thereon to keep the resilient elements in the second region subject to the second compression pressure; and the second region being located relative to the first region such that the second region is positionable to cover a central part of the selected area of the ground to be blasted, to suppress the movement of the ground in the central part of the selected area of the ground when blasted.

2. A blasting mat according to claim 1 in which:

the resilient elements comprise vehicle tire segments, said vehicle tire segments comprising first and second vehicle tire segments;

the first vehicle tire segments are located in the first region and are compressible at the preselected first compression pressure therefor, to compress the first region to the first density within the range of preselected first densities;

each of the first vehicle tire segments being a preformed portion of an automobile tire, each said preformed portion including a sidewall part of the automobile tire and a tread part of the automobile tire that are connected;

the second vehicle tire segments are located in the second region and are compressible at the preselected second compression pressure therefor, to compress the second region to the second density within the range of preselected second densities that are greater than the first density; and each of the second vehicle tire segments being a preformed portion of a truck tire, each said preformed portion comprising a tread part thereof, the second vehicle tire segments being more dense than the first vehicle tire segments.

3. A blasting mat according to claim 1 in which an opening is provided in a preselected position in the second region of the blasting mat, to permit access therethrough to an explosive charge located in the central part of the selected area of the ground to be blasted.

4. A blasting mat according to claim 2 in which the blasting mat additionally comprises a plurality of vehicle tire segments that are preformed portions of truck tires, the preformed portions of truck tires being located in respective end rows parallel to the rows of the resilient elements and located at the first and second ends, for strengthening the blasting mat.

5. A blasting mat comprising:

a blasting mat body extending between first and second ends thereof;

the blasting mat body comprising a first region comprising a plurality of first resilient elements arranged in a plurality of first resilient element rows;

the blasting mat body comprising a second region comprising a plurality of second resilient elements arranged in a plurality of second resilient element rows;

each said first resilient element comprising a first part of a compression molded body, the compression molded body having opposed upper and lower sides comprising at least one layer of a preselected composite material, each said first resilient element being subjected to a first compression pressure directed orthogonally to the upper side of the compression molded body to provide said at least one layer of the preselected composite material in the first part having a predetermined initial first density, each said first resilient element comprising a first portion of the upper side and an opposed first portion of the lower side, each said first resilient element being positioned in the blasting mat body to locate the first portions of the upper and lower sides facing the first and second ends;

each said second resilient element comprising a second part of the compression molded body, each said second resilient element being subjected to a second compression pressure directed orthogonally to the upper side of the compression molded body to provide said at least one layer of the preselected composite material in the second part having a predetermined initial second density, each said second resilient element comprising a second portion of the upper side and an opposed second portion of the lower side, each said second resilient element being positioned in the blasting mat body to locate the second portions of the upper and lower sides facing the first and second ends;

the first resilient elements additionally being compressed orthogonally to the first and second ends of the blasting mat body at a first preselected pressure to provide the first region with a first density that is greater than the initial first density and within a range of preselected first densities; and the second resilient elements additionally being compressed orthogonally to the first and second ends of the blasting mat body at a second preselected pressure to provide the second region with a second density that is greater than the initial second density, and within a range of preselected second densities that are greater than the first density.

6. A blasting mat according to claim 5 in which an opening is provided in a preselected position in the second region of the blasting mat, to permit access therethrough to an explosive charge when the blasting mat is secured in a predetermined location relative to the explosive charge.

7. A method of forming a blasting mat, the method comprising:

(a) providing a plurality of resilient elements;

(b) arranging the resilient elements in a plurality of parallel rows to provide a blasting mat body extending between a first end and a second end;

(c) drawing a plurality of cables through holes formed in the resilient elements respectively, each of the cables extending between two free ends thereof, the free ends of each said cable being located at the second end of the blasting mat body after the cables are drawn through the holes to connect the resilient elements together;

(d) with two plates engaged with the first and second ends respectively, compressing the resilient elements at a preselected first pressure directed orthogonally to the first and second ends to provide parallel first region rows in a first region of the blasting mat extending between a first exterior row at the first end and a first interior row located a first distance from the first end;

(e) while the resilient elements in the first region are compressed at the first pressure, securing clamps to the cables at the first interior row, to engage the resilient elements that are positioned in the first interior row, to maintain the resilient elements in the first region subjected to the preselected first pressure;

(f) with two plates engaged with the first and second ends respectively, compressing the resilient elements at a preselected second pressure directed orthogonally to the first and second ends to provide parallel second region rows in a second region of the blasting mat extending between the first interior row and a second row located a second distance from the first end, the preselected second pressure being greater than the preselected first pressure;

(g) while the resilient elements in the second region are compressed at the second pressure, securing clamps to the cables at the second row to engage the resilient elements that are positioned in the second row, to maintain the resilient elements in the second region subjected to the preselected second pressure, the second pressure being greater than the first pressure; and (h) releasing the plates from engagement with the first and second ends of the blasting mat body, to permit the resilient elements of the first region to partially release the second pressure, such that the resilient elements of the first region remain compressed at the preselected first pressure.

8. A method according to claim 7 in which the resilient elements are used vehicle tire segments.

9. A method according to claim 8 in which each of the used vehicle tire segments in the first region comprises a preformed portion of an automobile tire, each said preformed portion comprising a sidewall part of the automobile tire and a tread part of the automobile tire, the sidewall and tread parts being connected together.

10. A method according to claim 8 in which each of the used vehicle tire segments in the second region comprises a preformed portion of a truck tire, each said preformed portion comprising a part of tread thereof.

11. A method according to claim 7 in which:

the resilient elements located in the first region comprise a first part of a body formed by compression molding comprising at least one layer of a preselected first composite material having a predetermined first composite material density; and the resilient elements located in the second region comprise a second part of a body formed by compression molding comprising at least one layer of a preselected second composite material having a predetermined second composite material density greater than the first composite material density.

12. A method of forming a blasting mat, the method comprising:

(a) forming a compression molded body having an upper side and an opposed lower side, comprising the steps of:

(i) providing at least one layer of a first composite material;

(ii) providing at least one layer of rubber material;

(iii) heating said at least one layer of the first composite material and said at least one layer of the rubber material to a working temperature;

(iv) subjecting a first area of said at least one layer of the first composite material and said at least one layer of the rubber material to a first compression pressure directed orthogonally to the upper side, to form first resilient elements of the blasting mat with a predetermined initial first density;

(v) subjecting a second area of said at least one layer of the first composite material and said at least one layer of the rubber material to a second compression pressure directed orthogonally to the upper side, to form the second resilient elements of the blasting mat with a predetermined initial second density;

(b) cutting the first resilient elements from the first area of the compression molded body, each said first resilient element having first portions of the upper and lower sides;

(c) cutting the second resilient elements from the second area of the compression molded body, each said second resilient element having second portions of the upper and lower sides;

(d) arranging the first and second resilient elements in parallel rows respectively to form an uncompressed blasting mat body extending between first and second ends thereof, the first and second resilient elements being located in respective first and second regions in the blasting mat body;

(e) drawing a plurality of cables through holes formed in the first and second resilient elements, each of the cables extending between two free ends thereof, the free ends of each said cable being located at the second end of the blasting mat body after the cables are drawn through the holes to connect the first and second resilient elements together;

(f) with two plates engaged with the first and second ends respectively, compressing the first and second resilient elements at a preselected first pressure directed orthogonally to the first and second ends to provide parallel first region rows in a first region of the blasting mat extending between a first exterior row at the first end and a first interior row located a first distance from the first end;

(g) while the first resilient elements in the first region are compressed at the first pressure, securing clamps to the cables at the first interior row, to engage the first resilient elements that are positioned in the first interior row, to keep the first resilient elements in the first region subjected to the preselected first pressure;

(h) with two plates engaged with the first and second ends respectively, compressing the first and second resilient elements at a preselected second pressure directed orthogonally to the first and second ends to provide parallel second region rows in a second region of the blasting mat extending between the first interior row and a second row located a second distance from the first end, the preselected second pressure being greater than the preselected first pressure;

(i) while the second resilient elements in the second region are compressed at the second pressure, securing clamps to the cables at the second row to engage the second resilient elements that are positioned in the second row, to keep the second resilient elements in the second region subjected to the preselected second pressure, the second pressure being greater than the first pressure; and (j) releasing the plates from engagement with the first and second ends of the blasting mat body, to permit the first resilient elements to decompress to the preselected first pressure.

* * * * *